United States Patent [19]

Berzin et al.

[11] Patent Number: 4,840,231

[45] Date of Patent: Jun. 20, 1989

[54] METHOD AND APPARATUS FOR SETTING AN INFLATABLE PACKER

[75] Inventors: Vel Berzin; Luis E. Mendez, both of Houston, Tex.

[73] Assignee: Baker Hughes Incorporated, Houston, Tex.

[21] Appl. No.: 184,832

[22] Filed: Apr. 22, 1988

[51] Int. Cl.[4] ..... E21B 23/06

[52] U.S. Cl. ..... 166/387; 166/181; 166/187

[58] Field of Search ..... 166/387, 63, 181, 182, 166/183, 187, 192, 299

[56] References Cited

U.S. PATENT DOCUMENTS

| | | | |
|---|---|---|---|
| 2,681,114 | 6/1954 | Conrad | 166/181 |
| 2,695,065 | 11/1954 | Baker et al. | 166/181 |
| 3,138,207 | 6/1964 | Peppers | 166/187 |
| 3,762,470 | 10/1973 | Eggleston | 166/187 |
| 3,800,876 | 4/1974 | Eggleston | 166/63 |

*Primary Examiner*—Stephen J. Novosad

*Assistant Examiner*—Terry Lee Melius

*Attorney, Agent, or Firm*—Hubbard, Thurman, Turner & Tucker

[57] ABSTRACT

A setting assembly tool suitable for suspension in a subterranean well by a wireline is provided for activating an inflatable packer. A downhole firing head with a combustion device is utilized for generating downhole a high fluid pressure in a passageway of the setting assembly tool, with the passageway being in fluid communication with the packer for setting the packer. In response to a pressure buildup of a predetermined level, fluid pressure is dumped from the passageway to the well while a check valve closes to retain the packer in the set position. To deactivate the retrievable packer, a conventional fishing tool supported by a wireless may be used to exert an axial force on a housing sufficient to move the housing relative to the packer and open a fluid port for discharging liquid from the packer. The setting assembly tool may be retrieved to the surface via the wireline immediately after the packer is set.

15 Claims, 3 Drawing Sheets

METHOD AND APPARATUS FOR SETTING AN INFLATABLE PACKER

BACKGROUND OF THE INVENTION

1. Field of the Invention.

This invention relates to methods and apparatus for activating and deactivating pressure responsive downhole equipment and, more particularly, to methods and apparatus for setting and unsetting downhole retrievable inflation packers.

2. Description of the Prior Art.

Packers are widely used in the petroleum recovery industry for sealing against the well bore, the casing I.D. surface, or the O.D. surface of a tubing string. Packers may generally be categorized as either permanent packers or retrievable packers. As its name suggests, a permanent packer is intended to be set in the well and left in place for an indefinite period of time. A retrievable packer, on the other hand, is returned to the surface when its intended function is complete. Retrievable packers frequently must be able to be lowered downhole through a small diameter production tubing string, effectively seal against a large diameter casing, and then be returned to the surface through the tubing string. A retrievable packer is cost effective since the packer may be reused. Moreover, its retrieval to the surface is often critical in order that the packer not interfere with subsequent downhole operations.

Packers may be set or activated by either mechanical or hydraulic forces; the latter type is frequently called an inflation packer. Inflation packers, activated by fluid pressure, have certain advantages over packers activated by mechanically moving parts, including generally increased expansion capability. Thus, an inflation packer is generally preferred when the packer must pass from the surface downhole through a small diameter restriction, be activated or "set" to seal against a much larger diameter casing, and then be deactivated or "unset" and retrieved back to the surface through the small diameter restriction.

Prior art inflation packers are typically set by passing a pressurized fluid from the surface through a tubing string downhole to the packer. The pressurized fluid fills the expandable bladder or bladders of the packer, and pressurizes the bladder with an axially directed force for sealing engagement against the casing. For this reason, an inflatable packer is commonly referred to as a Production Injection Packer, or PIP.

With respect to mechanically activated packers, the packers may be set either by dropping a weight through the production tubing, or by using an explosive pressure setting assembly supported by a wireline. The latter device utilizes the products of combustion to move a slidable piston, which then operates various mechanical components in the packer to set the packer. A significant advantage of a wireline pressure setting device is that the expense of a surface rig or coil tubing mechanism is avoided. The disadvantages, however, of packers set by the movement of mechanical components relate to their generally reduced sealing area compared to inflation packers, and to the difficulty or impossibility of retrieving mechanically set packers through relatively small diameter restrictions.

SUMMARY OF THE INVENTION

The present invention relates to methods and apparatus for setting and unsetting a retrievable inflation-type packer. A pressure setting assembly tool is provided downhole conveniently supported by a wireline for setting one or more selectively positionable inflation packers also supported by the wireline. The downhole pressure setting assembly is provided with a conventional firing head for burning a power charge. Combustion forces move a burning chamber piston, which in turn pressurizes liquid in a chamber below the piston. The liquid chamber is in fluid communication with a passageway in the packer, and fluid pressure passes through the passageway, through a poppet check valve, and to the packer sealing elements to set the packer. In response to the buildup of fluid pressure in the packer to a predetermined pressure level after the packer is set, a first pin is sheared, allowing a pressure relief piston within the packer and in fluid communication with the pressurized fluid in the setting assembly to move, thereby expelling excess pressure from the packer to the well bore. This "dumping" of excess pressure to the well bore ensures that fluid pressure within the packer is maintained within a safe range. Simultaneous with this dumping of fluid pressure, the check valve in the setting assembly closes to trap fluid pressure in the packer and maintain the packer in the set position.

When the pressure relief piston moves in response to the shearing of the first pin, collet fingers are released, enabling the setting mandrel and burning chamber to be retrieved to the surface by the wireline. When the packer is to be deactivated, a conventional fishing tool may be used to grasp the downhole outer housing of the packer, and an upward force exerted to shear a second pin, thereby axially moving the outer housing with respect to a packer sub and opening a port to allow fluid from the packer to be discharged. The packer may then be retrieved to the surface via the wireline and fishing tool.

A check valve may be provided for initially passing well fluid into the liquid chamber of the downhole setting assembly or, alternatively, the liquid chamber may be substantially filled with a desired liquid before the setting assembly is lowered into the well. In either event, a substantial portion of the liquid chamber in the setting assembly will be filled with a substantially incompressible fluid prior to activation of the combustion charge, thereby minimizing the travel of the combustion chamber piston necessary to transmit sufficient pressurized fluid through the setting assembly to set the packer. The amount and type of power charge is selected for the particular well conditions, the size of the packer, and the number of packers to be activated. The size of the shear pin for securing the pressure relief piston is selected so that once the packer is set, the increasing fluid pressure will automatically be dumped to the well bore before pressure rises to a level which might cause rupture of the packer.

DESCRIPTION OF THE PREFERRED EMBODIMENTS

Figure 1:
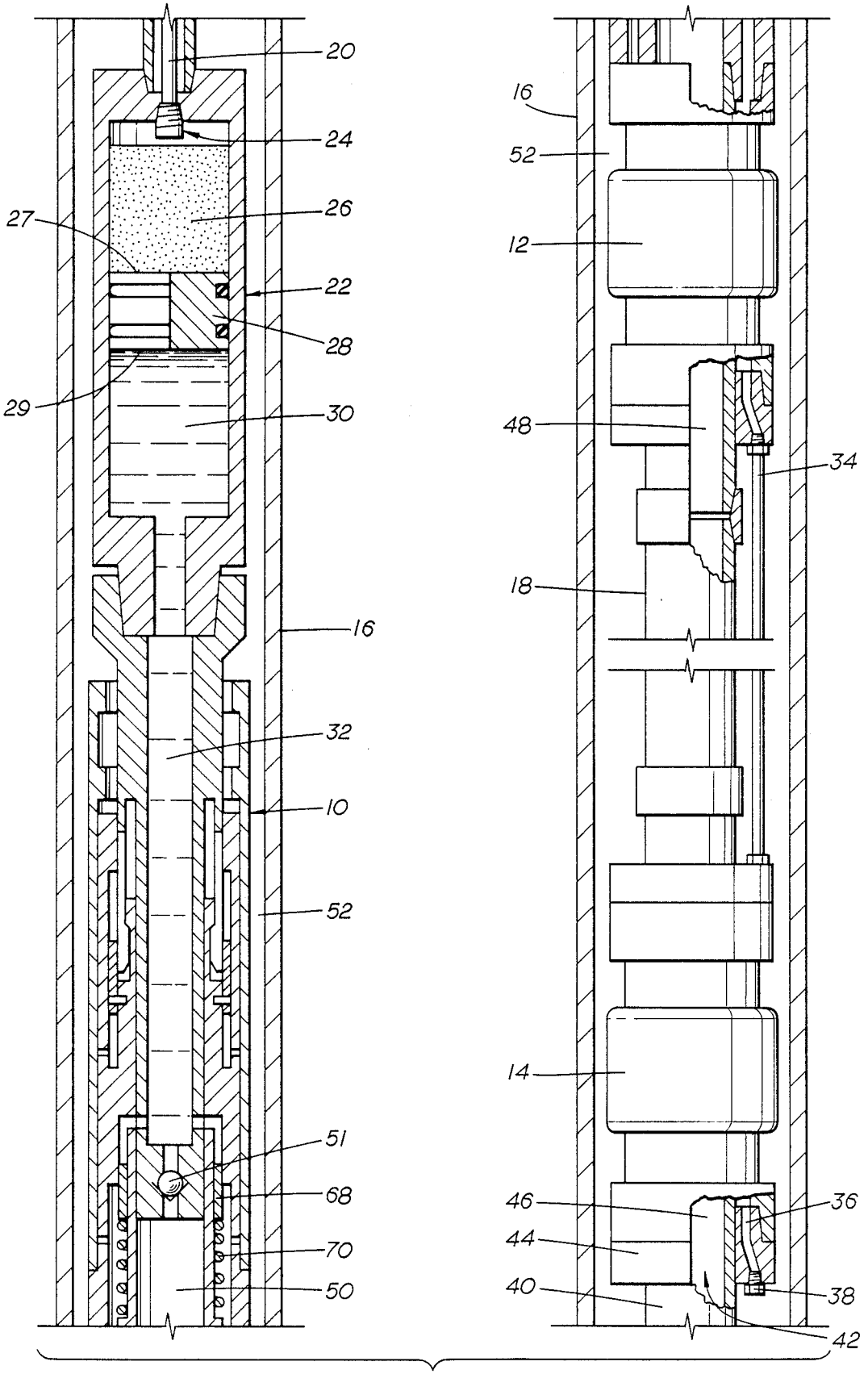
FIG. 1 is a pictorial representation, partially in cross-section, of a simplified pressure setting assembly, an upper packer, a side pocket mandrel, and a lower packer according to the present invention.

FIG. 1 depicts a pressure setting assembly 10 according to the present invention supported by a conventional wireline for setting an upper packer 12 into sealing engagement with the interior wall of casing 16. The assembly of the present invention may be used to set more than one packer, and accordingly FIG. 1 depicts a conventional side pocket mandrel 18 between the upper packer 12 and a lower packer 14.

The apparatus shown in FIG. 1 is supported by a conventional wireline 20, and may thus be activated and deactivated without the expense of a time consuming drilling rig or coil tubing apparatus. Directly connected to wireline 20 is a combustion device 22, including a firing head 24 for igniting the combustible materials in combustion chamber 26. The products of combustion create a pressure increase in chamber 26, which moves piston 28 downwardly, transferring the pressure increase to liquid chamber 30. The top surface 27 of piston 28 is exposed to fluid pressure within combustion chamber 26, while the lower surface 29 is exposed to fluid pressure in cavity 30. Piston 28 thus translates the pressure increase in chamber 26 to liquid chamber 30 by moving piston 28 downward during the combustion of the power charge.

As shown in FIG. 1, the surface area of 27 is equal to the surface area of 29, so that when piston 28 is stationary the pressure in combustion chamber 26 and liquid chamber 30 will be equal. It should be understood, however, that a pressure increase or a pressure decrease could easily be provided by appropriately sizing the exposed surfaces of piston 28. The combustion device 22 described herein, including the firing head 24, is similar to combustion devices previously utilized in the prior art to transmit forces through mechanical means to a mechanically actuated packer. According to the present invention, however, forces for activating the packer are not transmitted through mechanical components interconnecting the piston 28 and the packer, but instead are transmitted through fluid pressure to activate an inflatable packer. Further details regarding a suitable combustion device 22 according to the present invention are disclosed in a 26 page technical manual distributed by Baker Service Tools dated June 1, 1981 for Unit 4115, hereby incorporated by reference.

The other components of the setting assembly 10 simplicitly shown in FIG. 1 are structurally interconnected to combustion device 22, and form a passageway 32 for transmitting fluid pressure from cavity 30 to packer 12. Packer 12 is structurally connected at its top end to assembly 10, and at its bottom end to side pocket mandrel 18. Both packers 12 and 14 thus include a passageway in fluid communication with passageway 32 for transmitting fluid pressure to the inflatable member or members in the packer and, if desired, for passing pressurized fluid to another packer. Mandrel 18 thus separates the upper and lower packers shown in FIG. 1, and transmits fluid pressure to the lower packer 14 through passageway 34.

Packer sub 44 is structurally connected to the lower end of packer 14, and includes a passageway 36 also in fluid communication with the passageways 32, 34 and the inflatable members of the packers. During service, fluid may be removed from the passageways by unthreading plug 38. Finally, a bottom shoe 40 is shown connected to the packer sub 44 and having an opening 42 exposed to fluid within the well or casing 16.

As explained further below, it is preferable that passageways 32, 34, 36 and the expandable fluid chambers in the packers in fluid communication therewith be filled with a liquid before activating combustion device 22. Accordingly, prior to actuation of the device 22, fluid at substantially the pressure and temperature of the well fluid exterior to the components illustrated in FIG. 1 may enter the bottom shoe 40 through opening 42, and be passed upward through a central passageway 46 in a packer sub, through a central passageway in packer 14, through central passageway 48 in the side pocket mandrel 18, through a passageway in packer 12, through a central passageway 50 in setting assembly 10, past check valve 51, and into cavity 30, the passageways 32, 34, 36, and the inflatable members of the packers 12 and 14. Thus, the chambers to be subsequently subjected to increased fluid pressure because of the power charge are at least substantially filled with a substantially incompressible fluid, thereby reducing the distance piston 28 must travel to effectively set both packers.

It is also within the concept of the present invention to fill fluid cavity 30, passageways 32, 34, 36, and the expandable or inflatable members in the packers with a selected fluid, e.g., oil, prior to lowering the assembly shown in FIG. 1 into the well via wireline 20. One advantage of this latter technique is that fluid with abrasive and corrosive characteristics is not utilized to primarily occupy the passageways within the components illustrated in FIG. 1. Check valve 51 need not be employed and the passageway 50 permanently sealed from the passageway 32. In this event the selected fluid may be input into the passageway 32 and all cavities connected therewith at the surface, and opening 42 could be plugged. An advantage of this latter technique is that only selected fluid is used to fill the cavities and passageways to be subsequently pressurized, thereby increasing tool life and reliability. Even though the cavities are filled with a selected fluid at the surface, check valve 51 may still be employed to pass a small amount of well fluid into cavity 32, thereby further pressurizing all passageways to the downhole fluid pressure prior to activating device 22 to set the packers. In addition to the advantage gained by reducing the travel distance at piston 28, another advantage of using the check valve 51 is that the pressure within these passageways will be substantially equalized with the downhole pressure. The inflatable members in packers 12 and 14 will thus not be affected by downhole fluid pressure prior to activation of device 22 since the pressure in the interior of the packer expandable member will be substantially equal to the pressure in the interior 52 of the casing and exterior to the packer expandable member.

Figure 2:
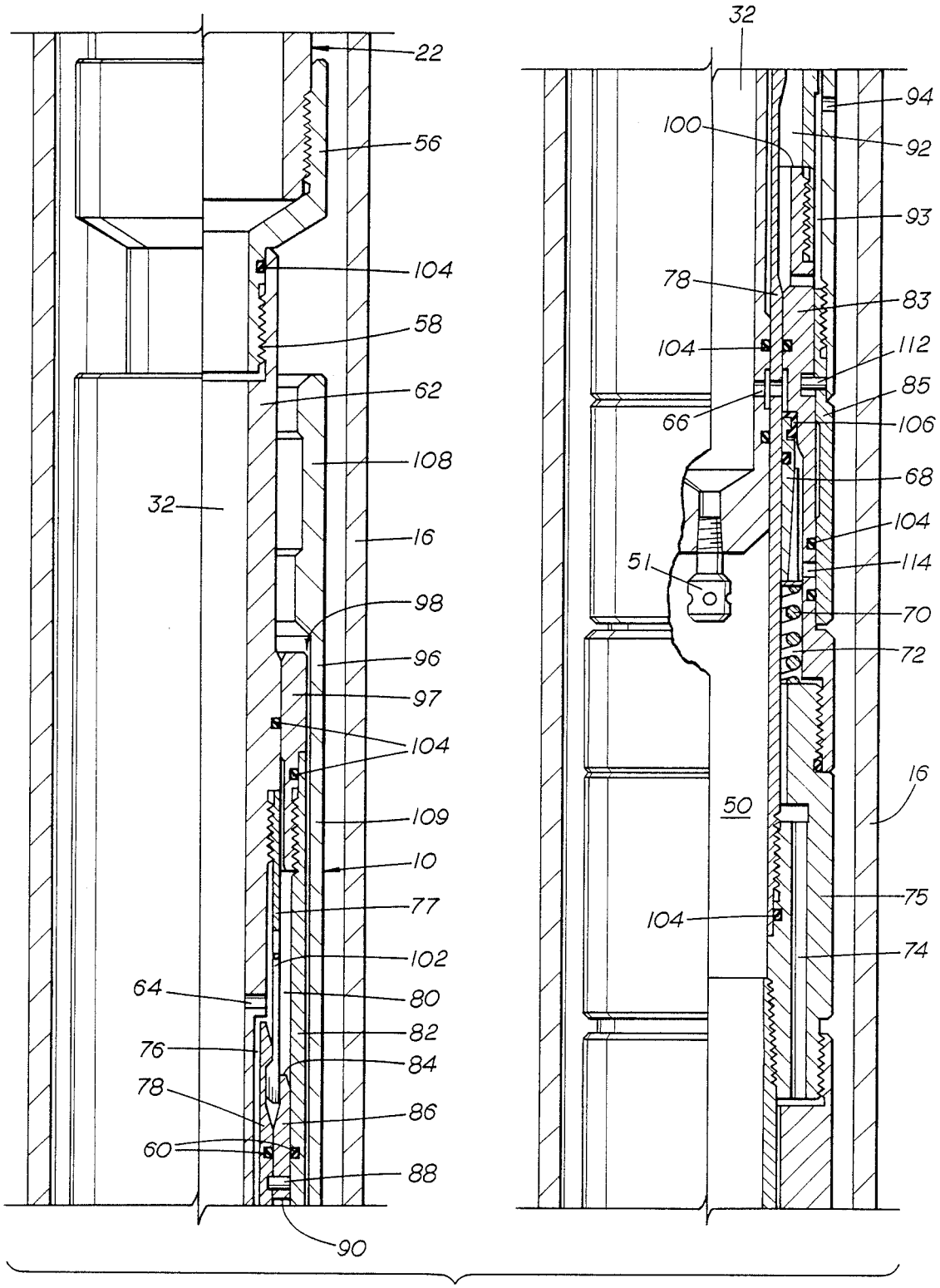
FIG. 2 is a vertically sectioned elevation view of a portion of the pressure setting assembly and the upper packer shown in FIG. 1 prior to activation of the combustion device.

FIG. 2 depicts in detail the portion of setting assembly 10 below combustion device 22 shown generally in FIG. 1, and the upper portion of the packer 12. Top sub 56 having threads 58 may be used to structurally interconnect combustion device 22 with setting mandrel 62, with O-ring seal 104 maintaining a fluid-tight relationship between these components. Mandrel 62 thus forms a portion of the sealed passageway 32 for transmitting pressure from liquid chamber 30 to one or more packers. Two ports 64 and 66 are provided for passing fluid from the interior to the exterior of the cylindrical-shaped mandrel 62.

When fluid pressure increases in passageway 32 to a preselected extent due to the actuation of combustion device 22, fluid pressure acting through port 66 presses against seal 106 in poppet valve 68, forcing the slidable valve member downward, compressing spring 70 and thereby establishing fluid communication between passageway 32 and passageway 72. Spring 70 thus exerts a preselected axially-directed force on poppet valve 68, so that the valve 68 will open only after a pre-selected nominal pressure is obtained in the setting assembly 10. Once valve 68 opens, pressurized fluid is transmitted from passageway 72 to passageway 74 in the top packer sub 75. Passageway 74 is in fluid communication with the expandable members of the packer, so that the packer will thus be subjected to pressurized fluid and will set in a conventional manner.

It is a particular feature of the invention to provide pressure relief means to prevent rupture of the expandable packer member due to a pressure increase in the setting assembly beyond an acceptable range. While the packer is being set, pressurized fluid from passageway 32 via port 64 is also increasing the fluid pressure in passageway 76 between setting mandrel 62 and the inner sleeve 78. The collet 77 is provided with a plurality of finger engaging members 102 which structurally interconnect collet 77 with inner sleeve 78 as explained subsequently. Fluid passes between the fingers, increasing fluid pressure in passageway 80. Upper surface 84 of piston member 86 is thus exposed to fluid in passageway 80, and as pressurized fluid rapidly increases in passageway 32 once the packer is set, the force exerted on the piston 86 will shear the pin 88 structurally interconnecting piston 86 to inner sleeve 78. Pin 88 is thus intended to shear when a preselected axial force is applied to the piston due to a pressure increase in passage 32, e.g., 1500 p.s.i., sufficient to effectively set the packer. It should be understood that the pressure value stated above to set a packer is the increased pressure over downhole pressure, and is merely exemplary of the pressure required to effectively seal the packer against casing.

The lower surface 90 of piston 86 is open to downhole pressure, so that pin 88 will shear when the fluid pressure in passageway 80 exerts a preselected force on surface 84 greater than the force exerted on face 90 of the piston due to downhole pressure. Once pin 88 shears, slidable piston 86 moves downward against stop surface 100 (see FIG. 3). This downward movement of piston 86 causes the piston to break sealing engagement with seal 60, and thus opens chamber 80 to the well bore annulus. Once fluid pressure in passageway 32 drops due to movement of piston 86, spring 70 closes poppet valve 68, thereby retaining 1500 p.s.i. in passageway 74 and retaining pressure to the packer sufficient to maintain effective sealing engagement with the casing. Passageway 92 beneath piston 86 was previously in fluid communication with the exterior of the assembly 10 and thus would normally be filled with well fluid. When pin 88 shears, movement of piston 86 thus expelled well fluid from the assembly 10 through U-shaped passageway 93 and out outport 94 provided in housing 96. A plurality of ports 94 thus ensure that well fluid can readily exit the assembly 10 as the piston moves downward, although well fluid could also be discharged in the space 98 between the sub 97 and housing 96.

As shown in FIG. 2, sub 97 is threadably connected to intermediate sleeve 82, which is turn serves as a guide for slidable piston 86. Seals 60 in sleeve 82 and in the inner sleeve 78 act against piston 86, sealing the passageway 32 from the exterior well fluid until pin 88 shears. Once piston 86 moves downward against stop surface 100, neither of the seals 60 remains in sealing engagement between the piston, the intermediate sleeve 82, and inner sleeve 78. At this stage, the packers 12, 14 are set and valve 68 is closed.

Extension sub 83 is threaded at its upper end for interconnection with intermediate sleeve 82, and is threaded at its lower end for interconnection with top packer sub 75. Top packer sub 75, in turn, is structurally connected to conventional inflatable packer components. O-ring seals 104 are provided for fluid-tight engagement between various parts described above, as shown in FIG. 2. Most of the components shown in FIG. 2 are at least partially contained within housing 109, which physically protects the various components while being lowered into the well.

Collet 77 is threadably connected to setting mandrel 62, and inner sleeve 78 is similarly connected to top packer sub 75. The collet has a plurality of conventional collet fingers 102, which engage the groove in the mandrel 78 and thus prevent axial movement of setting mandrel 62 relative to housing 109 until the packers are set and piston 86 moves downward against stop 100. Before the packers are set, piston 86 and setting mandrel 62 thus limit radial movement between the engaging fingers 104 to prevent disengagement of the fingers.

Figure 3:
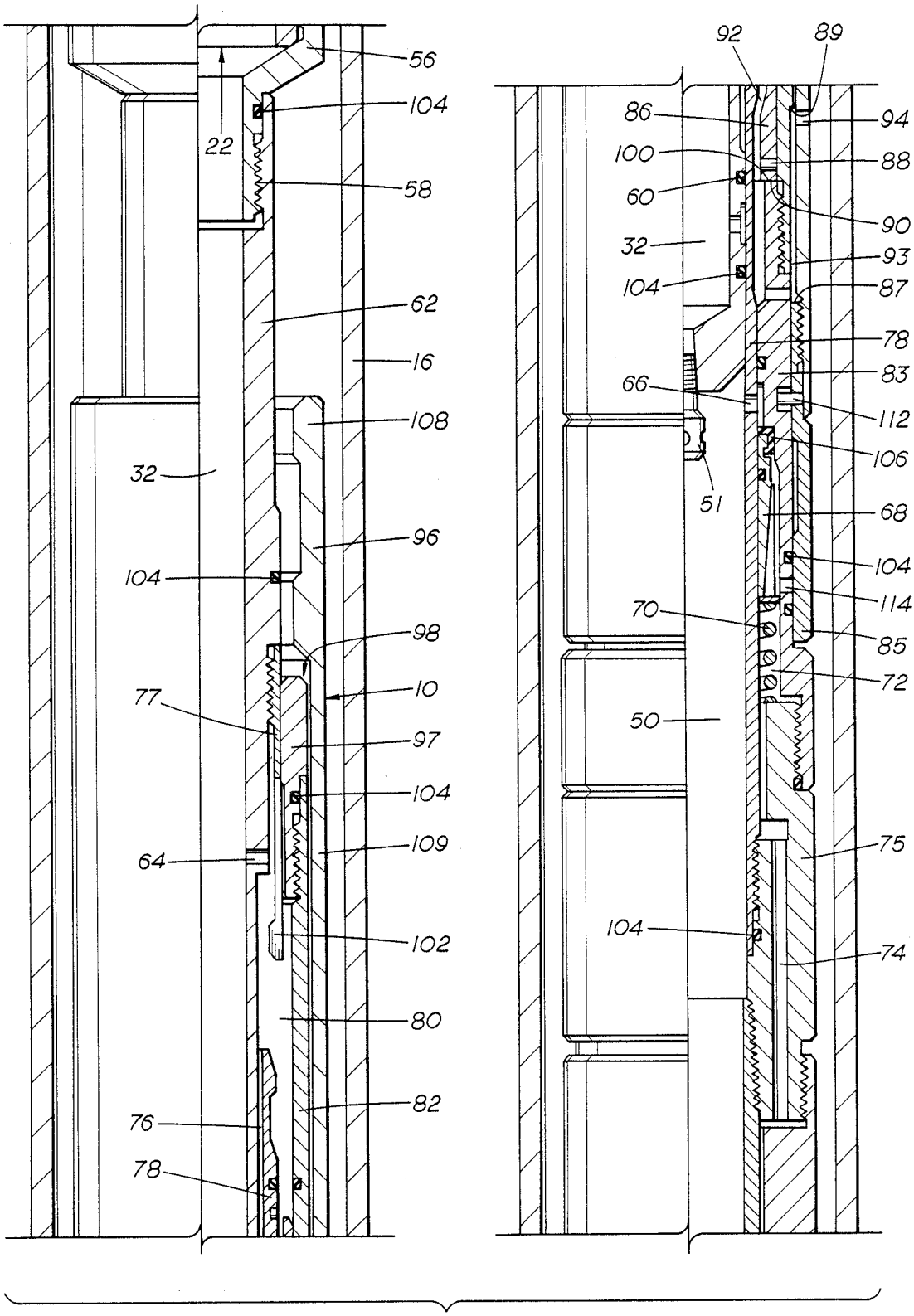
FIG. 3 is a vertically sectioned elevation view of a portion of the setting assembly and the upper packer after the packer has been set and showing the setting mandrel disconnected from the remaining portions of the setting assembly.

FIG. 3 illustrates a portion of the setting assembly 10 with the piston 86 against stop surface 100 and collet 77 disengaged from collet 78 by the above-described packer setting operation. Once the packers are set, fingers 102 of collet 77 are free to move against the interior diameter of intermediate sleeve 82. With the packer set, the wireline 20 may be lifted upward, retrieving to the surface the combustion device 22 and setting mandrel 62, the collet 77 and the check valve 51, while the remaining packer components remains downhole.

When it is desired to unset the packers, a conventional internal fishing tool (not shown) may be dropped downhole by wireline for engagement with the exposed upper fishing neck portion 108 of housing 109. Once the fishing tool has grasped the housing 109, an upward force may be exerted by the wireline until pin 112 shears. Pin 112 structurally interconnects the extension sub 83 and the sleeve 85 threaded to housing 109, and may, for example, be set to shear with an upward force of 1000 pounds applied on the wireline while the packers are set. Once pin 112 shears, sleeve 85 and housing 109 are free to move upward by the continued upward force on the wireline until stop surface 87 of sleeve 85 engages stop surface 89 of intermediate sleeve 82. At this point, port 114 in extension sub 83 will be open since seals 104 no longer engage sleeve 85, and fluid within the packer or packers may freely pass from the packer through passageway 74, passageway 72, and out port 114, thereby unsetting the packers. With the packers unset, the packer and any intermediate subs or apparatus connected thereto, may be removed by the wireline.

Thus the present invention enables inflatable packers to be easily and inexpensively set in a subterranean well, then unset and retrieved to the surface, by utilizing a wireline rather than coiled tubing or through production tubing. The components of a suitable inflatable packer according to the present invention which was not depicted in FIGS. 2 and 3 are disclosed in U.S. Pat. No. 4,349,204, and inflatable packers, side pocket mandrels, packer subs, and bottom shoes are well known in the art and are commercially available.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed or desired to be secured by Letters Patent is:

1. Apparatus for setting inflatable elastomeric packer sealing elements selectively positionable in a subterranean well bore by a wireline and radially movable for sealing engagement within the well bore in response to fluid pressure, the apparatus comprising:

pressure generating means suspended in said well bore by said wireline for pressurizing a liquid within a liquid chamber of said generating means;

pressure transmitting means having a fluid passageway in fluid communication with said liquid chamber for transmitting liquid pressure from said liquid chamber to said elastomeric packer sealing elements for moving the element into sealing engagement with said well bore check valve means for automatically closing said passageway in response to a decline in liquid pressure in said passageway; and pressure relief means in fluid communication with said passageway for relieving liquid pressure to said elastomeric packer sealing elements in excess of a selected level.

2. Apparatus as defined in claim 1, wherein said pressure relief means further comprises:

piston means slidably movable within said pressure transmitting means and having a first surface exposed to liquid pressure in said passageway and a second surface exposed to a downhole fluid pressure exterior of said pressure transmitting means.

3. Apparatus as defined in claim 2, further comprising:

piston shear means interconnecting said piston means and said pressure transmitting means for preventing movement of said piston means until liquid pressure in said passageway reaches a predetermined value.

4. Apparatus as defined in claim 2, wherein said pressure transmitting means further comprises:

an outer housing having an interior bore;

a setting mandrel axially movable within said interior bore and having a cavity forming a portion of said fluid passageway;

interconnection means positionable in a lock position for interconnecting said housing and said setting mandrel, and in a release position for enabling said setting mandrel to be axially moved with respect to said housing.

5. Apparatus as defined in claim 4, wherein said interconnection means further comprises:

retaining means responsive to movement of said piston means for retaining said interconnection means in said lock position until said piston means moves in response to said liquid pressure in said passageway.

6. Apparatus as defined in claim 4, further comprising:

a top packer sub interconnected to said packer; housing shear means interconnecting said housing and said top packer sub; and a discharge port in fluid communication with said passageway for discharging liquid from said elastomeric packer sealing elements in response to movement of said housing relative to said top packer sub upon shearing the housing shear means.

7. Apparatus as defined in claim 6, wherein said housing further comprises:

a fishing tool receiving means for selective engagement with a fishing tool and for enabling an axial force on said fishing tool to shear said housing shear means.

8. Apparatus as defined in claim 1, wherein said pressure generating means comprises:

a combustion chamber for receiving a combustible material; and a combination chamber piston slidably movable between said combustion chamber and said liquid chamber for transmitting pressure forces generated by combustion of said combustible material from said combustion chamber to said liquid chamber.

9. Apparatus as defined in claim 1, wherein said check valve means is hydraulically in parallel with said pressure relief means.

10. Apparatus for setting inflatable elastomeric packer sealing elements selectively positionable in a subterranean well bore by a wireline, the elastomeric packer sealing elements being radially movable in response to fluid pressure for sealing engagement within the well bore, the apparatus comprising:

a combustion chamber for receiving a combustible material;

a fluid chamber for containing a liquid;

a combustion chamber piston slidably movable between said combustion chamber and said fluid chamber for transmitting pressure forces generated by combustion of said combustible material from said combustion chamber to said liquid in said fluid chamber;

pressure transmitting means having a fluid passageway in fluid communication with said fluid chamber for transmitting pressure from said liquid chamber to said inflatable elastomeric packer sealing elements for sealing engagement within said subterranean well bore; and auxiliary piston means slidably movable within said pressure transmitting means and having a first surface exposed to downhole fluid pressure exterior of said pressure transmitting means for relieving liquid pressure to said inflatable elastomeric packer sealing elements in excess of a selected level.

11. Apparatus as defined in claim 10, wherein said pressure transmitting means further comprises:

an outer housing having an interior bore;

a setting mandrel axially movable within said interior bore and having a cavity defining a portion of said fluid passageway;

interconnection means positionable in a lock position for interconnecting said housing and said setting mandrel, and in a release position for enabling said setting mandrel to be axially moved with respect to said housing.

12. Apparatus as defined in claim 11, wherein said interconnection means further comprises:

retaining means responsive to movement of said piston means for retaining said interconnection means in said lock position until said piston means moves in response to said liquid pressure in said passageway.

13. Apparatus as defined in claim 11, wherein said housing further comprises:

a top packer sub interconnected to said packer;

housing shear means interconnecting said housing and said top packer sub;

a discharge port in fluid communication with said passageway for discharging liquid from said elastomeric packer sealing elements in response to movement of said housing relative to said top packer sub upon shearing the housing shear means; and a fishing tool receiving means for selective engagement with a fishing tool and enabling an axial force on said fishing tool to shear said housing shear means.

14. A method for setting an inflatable packer selectively positionable in a subterranean well by a wireline, comprising:

suspending a pressure generating source in said subterranean well by said wireline;

suspending a liquid filled chamber in said subterranean well by said wireline;

suspending a packer in said subterranean well by said wireline;

activating said pressure generating source while in said well to substantially increase liquid pressure in said liquid filled chamber;

transmitting said increased liquid pressure in said liquid chamber to said packer to inflate said packer in said subterranean well;

releasing liquid pressure in said liquid chamber in excess of a selected packer setting pressure level; and retaining liquid pressure in said packer at substantially said selected packer setting level while releasing excess liquid pressure in said liquid chamber.

15. The method as defined in claim 14, further comprising:

pressuring said liquid filled chamber by exposing said chamber to downhole fluid pressure prior to activating said pressure generating source.

* * * * *